US010438764B2

(12) United States Patent
Choi et al.

(10) Patent No.: US 10,438,764 B2
(45) Date of Patent: Oct. 8, 2019

(54) FIELD EMISSION APPARATUS

(71) Applicant: ELECTRONICS AND TELECOMMUNICATIONS RESEARCH INSTITUTE, Daejeon (KR)

(72) Inventors: Young Chul Choi, Daejeon (KR); Yoon-Ho Song, Daejeon (KR); Hyo Jin Jeon, Daejeon (KR); Jun Tae Kang, Daejeon (KR); Sora Park, Seoul (KR); Jeong Woong Lee, Gongju (KR); Eunsol Go, Daejeon (KR); Min-Sik Shin, Daejeon (KR); Jae-Woo Kim, Daejeon (KR); Jin-Woo Jeong, Daejeon (KR); Ji-Hwan Yeon, Daejeon (KR); Sunghee Kim, Cheongju (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/835,073

(22) Filed: Dec. 7, 2017

(65) Prior Publication Data

US 2018/0158640 A1 Jun. 7, 2018

(30) Foreign Application Priority Data

Dec. 7, 2016 (KR) ..... 10-2016-0166155
Jun. 29, 2017 (KR) ..... 10-2017-0082825

(51) Int. Cl.

| | |
|---|---|
| ***H01J 35/14*** | (2006.01) |
| ***H01J 29/62*** | (2006.01) |
| ***H01J 35/06*** | (2006.01) |
| ***H01J 29/08*** | (2006.01) |

(52) U.S. Cl.
CPC ..... *H01J 29/62* (2013.01); *H01J 29/085* (2013.01); *H01J 35/065* (2013.01); *H01J 35/14* (2013.01); *H01J 2235/062* (2013.01)

(58) Field of Classification Search
CPC ..... H01J 35/045; H01J 35/14; H01J 29/62
USPC ..... 313/297
See application file for complete search history.

(56) References Cited

U.S. PATENT DOCUMENTS

| | | | | |
|---|---|---|---|---|
| 9,048,059 | B2 | 6/2015 | Jeong et al. | |
| 9,536,695 | B2 * | 1/2017 | Liu | H01J 31/127 |
| 10,283,311 | B2 * | 5/2019 | Jeong | H01J 35/065 |

(Continued)

FOREIGN PATENT DOCUMENTS

| | | |
|---|---|---|
| KR | 10-2013-0011795 A | 1/2013 |
| KR | 10-2016-0061247 A | 5/2016 |

OTHER PUBLICATIONS

Chi Li et al., "Highly Electron Transparent Graphene for Field Emission Triode Gates", Advanced Functional Materials, 2014, p. 1218-1227, vol. 24, Wiley-VCH Verlag GmbH & Co. KGaA, Weinheim.

*Primary Examiner* — Christopher M Raabe

(57) ABSTRACT

Disclosed is a field emission apparatus. The apparatus comprises a cathode electrode and an anode electrode spaced apart from each other, an emitter on the cathode electrode, a gate electrode between the cathode and anode electrodes and including at least one gate aperture overlapping the emitter, and an electron transmissive sheet on the gate electrode and including a plurality of fine openings overlapping the gate aperture.

16 Claims, 10 Drawing Sheets

(56) References Cited

U.S. PATENT DOCUMENTS

| | | | | |
|---|---|---|---|---|
| 2004/0135490 | A1* | 7/2004 | Lee | H01J 29/467 313/495 |
| 2006/0202608 | A1* | 9/2006 | Chen | H01J 9/185 313/495 |
| 2010/0141866 | A1* | 6/2010 | Ryu | H01J 63/02 349/61 |
| 2010/0156305 | A1* | 6/2010 | Jeong | G09G 3/22 315/209 R |
| 2013/0169142 | A1* | 7/2013 | Hyde | H01J 3/021 313/296 |
| 2016/0148774 | A1 | 5/2016 | Park et al. | |
| 2017/0053771 | A1* | 2/2017 | Jeong | H01J 35/065 |

* cited by examiner

FIELD EMISSION APPARATUS

CROSS-REFERENCE TO RELATED APPLICATIONS

This U.S. nonprovisional patent application claims priority under 35 U.S.C § 119 of Korean Patent Application Nos. 10-2016-0166155 filed on Dec. 7, 2016 and 10-2017-0082825 filed on Jun. 29, 2017 entire contents of which are hereby incorporated by reference.

BACKGROUND

The present inventive concept relates to a field emission apparatus, and more particularly, to a field emission apparatus having enhanced focusing capability of an electron beam and improved electron transmission performance.

A field emission apparatus is applicable a variety of devices such as field emission displays, engineering X-ray tubes, and medical X-ray tubes. A performance of the field emission apparatus is essentially affected by controlling characteristics of current density, focusing of field-emitted electron beam, etc. For example, the characteristics of electron beam may be controlled through a material of an emitter or a structure of the field emission apparatus.

A diode-structure field emission apparatus with two electrodes has an anode electrode and a cathode electrode which is attached with an emitter for emitting electrons. Considering a distance between the cathode and anode electrodes, a relatively large voltage is required in a field emission, and this leads to difficulty in controlling the emitted electron beams.

In order to solve the problem, it has been proposed a triode-structure field emission apparatus including three electrodes. The triode-structure field emission apparatus additionally includes a gate electrode as well as the cathode and anode electrode. The triode-structure field emission apparatus uses the gate electrode to control a current magnitude, an electron beam size, focusing of the electron beam, etc.

The gate electrode has a shape having apertures so as to have electron transmission characteristics. It therefore is possible to increase transmission efficiency of electrons from the emitter to the anode electrode. Characteristics of the electron beam are greatly affected by structural features such as size and arrangement of the aperture of the gate electrode. The larger size of the aperture may lead to a higher magnitude of emitted current reaching the anode electrode after passing through the gate electrode. However, the aperture of the gate electrode may induce distortion of potential distribution between the gate electrode and the cathode electrode. Accordingly, a reduced field effect may be applied to the emitter. In addition, the electron beam emitted from the emitter may be distorted in trajectory path. This may result in reducing electron emission of the emitter, in spreading the electron beam, and in decreasing magnitude of the emitted current reaching an effective area of the anode electrode.

Therefore, it is required a field emission apparatus having excellent electron transmission and enhanced focusing capability of the electron beam by reducing potential profile distortion around the aperture.

SUMMARY

Embodiments of the present inventive concept provide a field emission apparatus having enhanced focusing capability of the electron beam and excellent electron transmission performance.

Embodiments of the present inventive concept provide a field emission apparatus including electron transmissive sheet and having enhanced production yield.

An object of the present inventive concept is not limited to the above-mentioned one, other objects which have not been mentioned above will be clearly understood to those skilled in the art from the following description.

According to exemplary embodiments of the present inventive concept, a field emission apparatus may comprise: a cathode electrode and an anode electrode spaced apart from each other; an emitter on the cathode electrode; a gate electrode between the cathode and anode electrodes and including at least one gate aperture overlapping the emitter; and an electron transmissive sheet on the gate electrode and including a plurality of fine openings overlapping the gate aperture.

In some embodiments, the electron transmissive sheet may comprise at least one electron transmissive atomic layer. The electron transmissive atomic layer may include a two-dimensional material.

In some embodiments, the two-dimensional material may comprise at least one of graphene, molybdenum disulfide (MoSO2), tungsten disulfide (WS2), hexagonal boron nitride (h-BN), molybdenum ditelluride (MoTe2), and transition metal dichalcogenide (TMDC).

In some embodiments, each of the fine openings may have a width less than a spacing between the fine openings adjacent to each other.

In some embodiments, the width of each of the fine openings may be more than zero and less than one-third a width of the gate aperture.

In some embodiments, the width of each of the fine openings may be less than one-third a spacing between the cathode electrode and the gate electrode.

In some embodiments, the gate aperture may have a width greater than that of the emitter.

In some embodiments, the apparatus may further comprise at least one focusing electrode between the anode electrode and the gate electrode. The focusing electrode may comprise a focusing electrode aperture vertically overlapping the gate aperture.

In some embodiments, the emitter may be positioned on a surface of the cathode electrode. The surface of the cathode electrode may face the anode electrode.

In some embodiments, the anode electrode may comprise a target on its surface facing the cathode electrode.

In some embodiments, the gate electrode may comprise a first surface facing the cathode electrode and a second surface facing the anode electrode. The electron transmissive sheet may be positioned on either the first surface or the second surface.

In some embodiments, the cathode electrode and the gate electrode may be spaced apart at a spacing of more than about 150 μm and less than about 500 μm.

In some embodiments, at least one of the fine openings may have a different width from those of other fine openings.

In some embodiments, the fine opening may have a width within a range in which a trajectory of an electron beam emitted from the emitter is not substantially distorted by distortion of potential distribution caused by the fine opening.

Details of other exemplary embodiments are included in the description and drawings.

DETAILED DESCRIPTION OF EMBODIMENTS

Embodiments of the present inventive concept will hereinafter be described in detail with reference to the accompanying drawings so as to allow a skilled person in the art to easily implement the technical spirit of the present invention.

Figure 1:
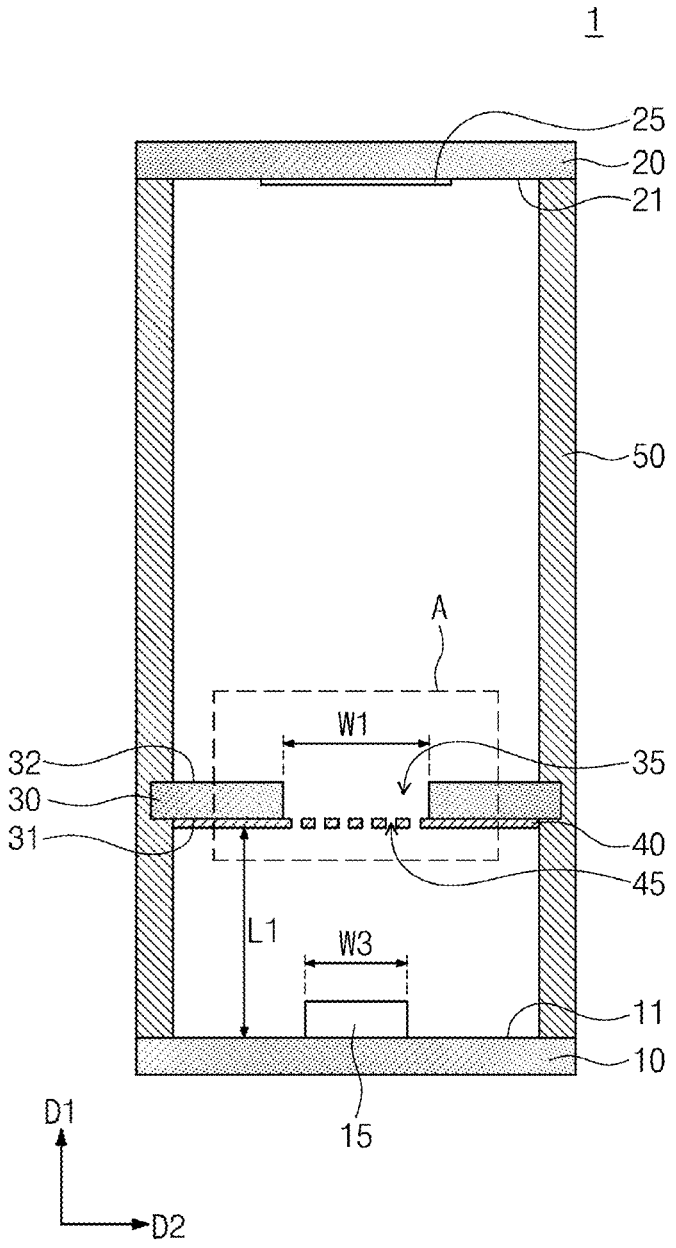
FIG. 1 illustrates a schematic diagram showing a field emission apparatus according to exemplary embodiments of the present inventive concept.

FIG. 1 illustrates a schematic diagram showing a field emission apparatus according to exemplary embodiments of the present inventive concept.

Referring to FIG. 1, a field emission apparatus 1 according to embodiments of the present inventive concept may emit an electron beam. The field emission apparatus 1 may include a cathode electrode 10, an anode electrode 20, a gate electrode 30, an emitter 15, and an electron transmissive sheet 40. The field emission apparatus 1 may further include an insulation member 50.

The cathode and anode electrodes 10 and 20 may be spaced apart from each other. The anode electrode 20 may be spaced apart from the cathode electrode 10 in a traveling direction of the electron beam emitted from the cathode electrode 10. For example, the anode electrode 20 may be spaced apart from the cathode electrode 10 in a first direction D1.

The cathode and anode electrodes 10 and 20 may face each other. The cathode electrode 10 may have a top surface 11 facing the anode electrode 20. The anode electrode 20 may have a bottom surface 21 facing the cathode electrode 10. The top surface 11 of the cathode electrode 10 may be parallel to the bottom surface 21 of the anode electrode 20. The cathode and anode electrodes 10 and 20 may vertically overlap each other.

One or more external power sources (not shown) may be connected to the cathode electrode 10, the anode electrode 20, and the gate electrode 30. For example, the cathode electrode 10 may be connected to a negative or positive voltage source, and the anode electrode 20 and the gate electrode 30 may be connected to a voltage source whose potential is relatively greater than that of the voltage source connected to the cathode electrode 10.

The anode electrode 20 may include a target 25 provided on the bottom surface 21 thereof. In some embodiments, the target 25 may be a fluorescent substance. The target 25 may emit light on collision with the electron beam emitted from the emitter 15. In other embodiments, the target 25 may be a substance that emits an X-ray on collision with the electron beam. For example, the target 25 may include tungsten.

The gate electrode 30 may be positioned between the cathode electrode 10 and the anode electrode 20. The gate electrode 30 may be upwardly spaced apart from the cathode electrode 10. The gate electrode 30 may be downwardly spaced apart from the anode electrode 20. The gate electrode 30 may include a first surface 31 facing the cathode electrode 10 and a second surface 32 facing the anode electrode 20. The first and second surfaces 31 and 32 may oppositely face each other. The cathode and gate electrodes 10 and 30 may be spaced apart from each other at a spacing L1 in the range of about tens to hundreds of μm. The spacing L1 is depended on a property of the emitter 15 and/or on a structural feature of the gate electrode 30. For example, the spacing L1 between the cathode and gate electrodes 10 and 30 may be in the range between about 150 μm and about 500 μm, but the present inventive concept is not limited thereto. In some embodiments, the spacing L1 may be about 200 μm. The spacing L1 may be a distance between the top surface 11 of the cathode electrode 10 and the first surface 31 of the gate electrode 30. In addition, the spacing L1 between the cathode and gate electrodes 10 and 30 may be determined corresponding to a width W3 of the emitter 15 and/or a width W1 of a gate aperture 35.

A conductive material may be included in the cathode electrode 10, the anode electrode 20, and the gate electrode 30. For example, the cathode electrode 10, the anode electrode 20, and the gate electrode 30 may include copper (Cu), aluminum (Al), molybdenum (Mo), etc. In some embodiments, the cathode electrode 10, the anode electrode 20, and the gate electrode 30 may be shaped like a circular plate or disc, but the present inventive concept is not limited thereto. The gate electrode 30 may include at least one gate aperture 35 penetrating therethrough. In some embodiments, the gate electrode 30 may include one gate aperture 35. In other embodiments, the gate electrode 30 may include a plurality of gate apertures 35. The gate aperture 35 will be further discussed in detail below.

The emitter 15 may be provided on the cathode electrode 10. For example, the emitter 15 may be provided on the top surface 11 of the cathode electrode 10. The emitter 15 may be provided in plural. The emitter 15 may include one or more carbon nanotubes arranged in a dot array, but the present inventive concept is not limited thereto. The carbon nanotube may have a hollow tube shape in which carbon atoms are hexagonally connected to each other. The emitter 15 may emit electrons and/or an electron beam when a field is generated from voltages applied to the cathode electrode 10, the anode electrode 20, and the gate electrode 30.

The electron transmissive sheet 40 may be provided on the gate electrode 30. In some embodiments, the electron transmissive sheet 40 may be provided on the first surface 31 of the gate electrode 30. In other embodiments, the electron transmissive sheet 40 may be provided on the second surface 32 of the gate electrode 30. The electron transmissive sheet 40 will be further discussed in detail below with reference to FIG. 3.

The insulation member 50 may be positioned between the cathode electrode 10 and the anode electrode 20. The insulation member 50 may electrically insulate the cathode electrode 10, the anode electrode 20, and the gate electrode 30 from each other. The insulation member 50 may be a vacuum spacer and/or an insulating spacer. In some embodiments, the insulation member 50 may include one end connected to the top surface 11 of the cathode electrode 10 and an opposite end connected to the bottom surface 21 of the anode electrode 20. The insulation member 50 may be provided to have a tube shape whose top and bottom ends are opened, but the present inventive concept is not limited thereto. The insulation member 50 may be coupled to the gate electrode 30. For example, the insulation member 50 may surround the gate electrode 30. The insulation member 50 may include an insulating material.

The electrons and/or electron beam emitted from the emitter 15 may be generated and accelerated in a vacuum state. Accordingly, an inner pressure of the field emission apparatus 1 may be reduced to a vacuum state by a vacuum pump. The insulation member 50 may include a stable and tough material even in the vacuum state. For example, the insulation member 50 may include ceramic, aluminum oxide, aluminum nitride, glass, etc.

Figure 2A:
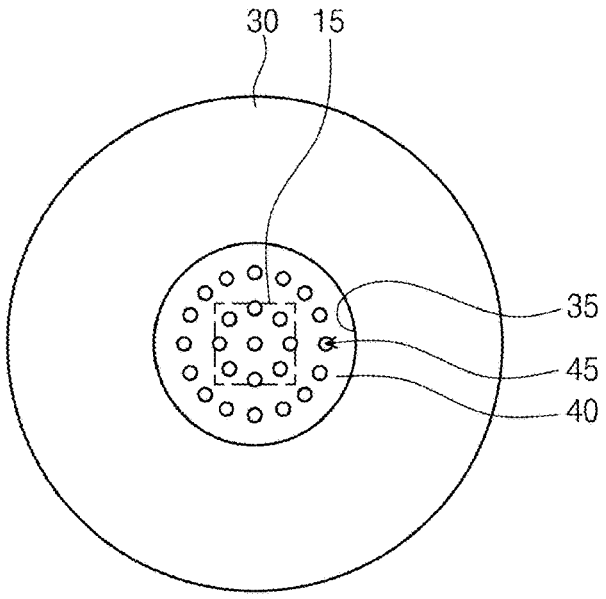
FIG. 2A illustrates a plan view showing a gate electrode and an electron transmissive sheet of FIG. 1.
Figure 2B:
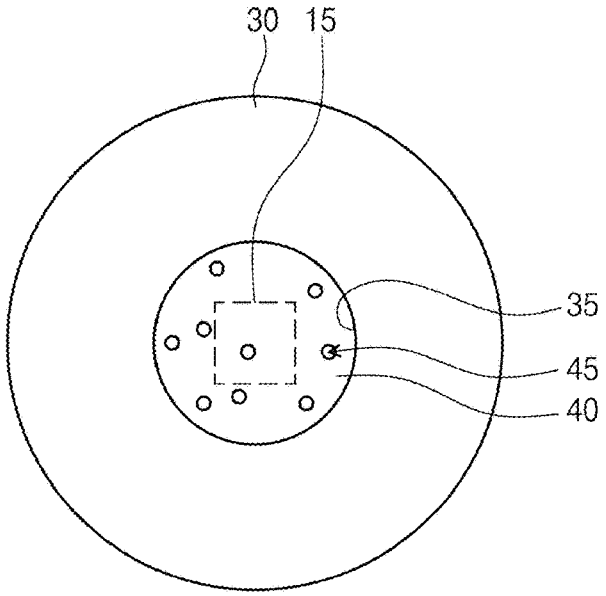
FIG. 2B illustrates a plan view showing another example of a gate electrode and an electron transmissive sheet of FIG. 1.
Figure 3:
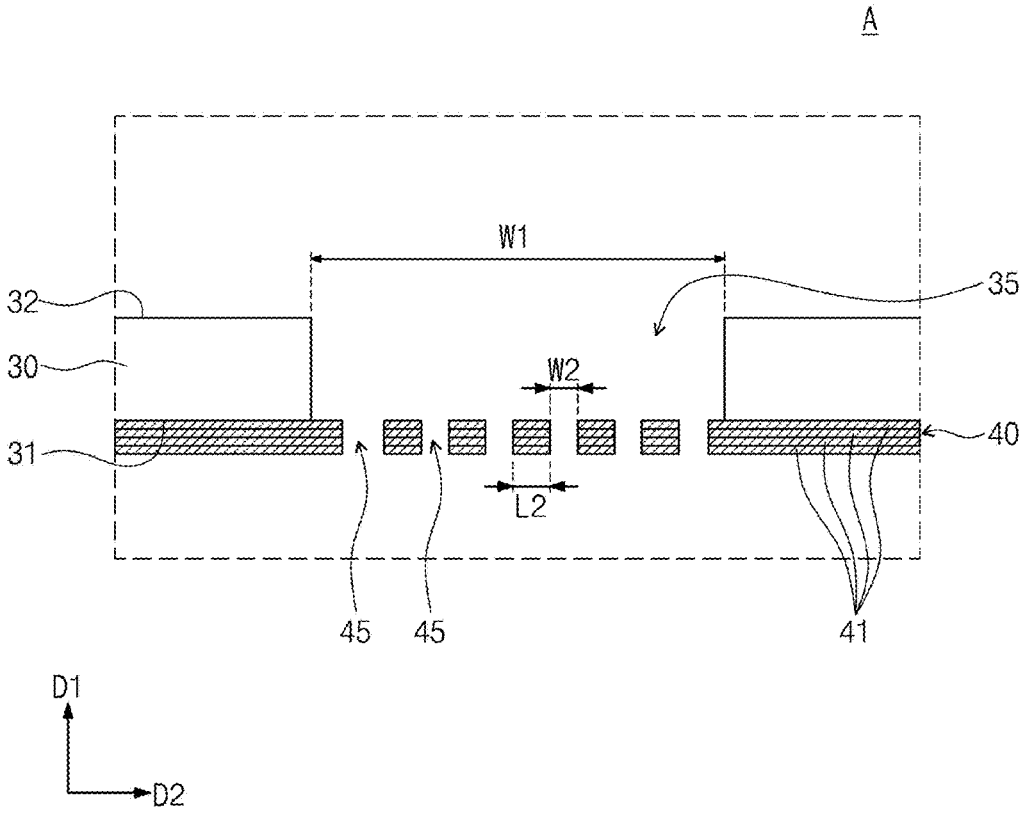
FIG. 3 illustrates an enlarged view of section A of FIG. 1.

FIG. 2A illustrates a plan view showing a gate electrode and an electron transmissive sheet of FIG. 1. FIG. 2B illustrates a plan view showing another example of a gate electrode and an electron transmissive sheet of FIG. 1. FIG. 3 illustrates an enlarged view of section A of FIG. 1.

Referring to FIGS. 1, 2A, 2B, and 3, the gate aperture 35 may be spaced apart from the emitter 15 in the first direction D1. The gate aperture 35 may vertically overlap the emitter 15. The width W1 of the gate aperture 35 may be greater than the width W3 of the emitter 15. As illustrated in FIG. 2A, the emitter 15 may be positioned within the gate aperture 35, in plan view. In some embodiments, the gate aperture 35 may have a roughly circular shape, in plan view. In other embodiments, the gate aperture 35 may have a roughly polygonal shape, in plan view.

The width W1 of the gate aperture 35 may be in the range of tens to hundreds of μm depending on characteristics and structural features of the emitter 15 on the cathode electrode 10. For example, the width W1 of the gate aperture 35 may be in the range between about 100 μm and about 400 μm. In some embodiments, the width W1 of the gate aperture 35 may be about 350 μm. The width W1 of the gate aperture 35 may be greater than the spacing L1. In other embodiments, the width W1 of the gate aperture 35 may be the same as or less than the spacing L1.

The electron transmissive sheet 40 may be provided on the gate electrode 30. In some embodiments, a transfer process may be carried out to provide the electron transmissive sheet 40 on the gate electrode 30, but the present inventive concept is not limited thereto. The transfer process of the electron transmissive sheet 40 will be further discussed in detail below. When the electron transmissive sheet 40 overlaps the gate aperture 35, a thermal and/or mechanical stress may be generated between the electron transmissive sheet 40 and the gate electrode 30.

The electron transmissive sheet 40 may have a plurality of fine openings 45 vertically overlapping the gate aperture 35. The plurality of fine openings 45 may relieve the stress. In some embodiments, the fine openings 45 may have a roughly circular shape, in plan view. Alternatively, in other embodiments, the fine openings 45 may have a roughly polygonal or irregular shape, in plan view.

A potential distribution distortion may occur around the fine openings 45. It therefore may be essential that a width W2 of any fine opening 45 is appropriately set within a range that cannot distort a traveling path of the electron beam. The appropriate width W2 of any fine opening 45 may be obtained when the electron beam is analyzed in its traveling path influenced by a local potential distribution distortion around the fine openings 45. For example, based on the analysis of the traveling path of the electron beam, each width W2 of the fine openings 45 may be obtained within the range that cannot distort the traveling path of the electron beam. In this sense, each width W2 of the fine openings 45 may be in the range of several to tens of μm.

In order to avoid perverting the traveling path of the electron beam, each width W2 of the fine openings 45 may be more than zero and less than one-third the width W1 of the gate aperture 35. For example, the width W1 of the gate aperture 35 may be in the range between about 100 μm and about 400 μm, and each width W2 of the fine openings 45 may be in the range, but not limited to, between about 5 μm and about 45 μm. In some embodiments, the width W1 of the gate aperture 35 may be about 350 μm, and the width W2 of the fine openings 45 may averagely be about 5 μm.

In addition or alternatively, in order to avoid perverting the traveling path of the electron beam, each width W2 of the fine openings 45 may be less than one-third the spacing L1 between the cathode electrode 10 and the gate electrode 30. For example, the spacing L1 between the cathode electrode 10 and the gate electrode 30 may be in the range of more than about 150 μm, and each width W2 of the fine openings 45 may be in the range, but not limited to, between about 5 μm and about 45 μm.

At least one of the fine openings 45 may have a different width from those of other fine openings 45. The fine openings 45 may be spaced apart from each other. As illustrated in FIG. 2A, the fine openings 45 may be arranged in a regular pattern, in plan view. For example, the fine openings 45 may be arranged in a concentric pattern, in plan view. Alternatively, as illustrated in FIG. 2B, the fine openings 45 may be arranged in an irregular pattern, in plan view.

Neighboring ones of the fine openings 45 may be spaced apart at a spacing L2 (referred to hereinafter as a first spacing) in the range of tens to hundreds of μm depending on the width W1 of the gate aperture 35. For example, the first spacing L2 may be in the range between about 50 μm and about 150 μm, but the present inventive concept is not limited thereto. The first spacing L1 between the fine openings 45 adjacent to each other may be greater than each width W2 of the fine openings 45. In some embodiments, the same first spacing L2 may be provided between any adjacent ones of the fine openings 45. In other embodiments, at least one of the first spacings L2 between the fine openings 45 may be different from those between other fine openings 45.

The electron transmissive sheet 40 may include at least one electron transmissive atomic layer 41 (referred to hereinafter as an atomic layer). In some embodiments, the electron transmissive sheet 40 may have a structure in which two or more atomic layers 41 are stacked.

Each of the atomic layers 41 may include a two-dimensional material. The term "two-dimensional material" may mean a two-dimensionally arranged material. For example, the two-dimensional material may include one or more of graphene, molybdenum disulfide ($MoSO_2$), tungsten disulfide ($WS_2$), hexagonal boron nitride (h-BN), molybdenum ditelluride ($MoTe_2$), transition metal dichalcogenide (TMDC), and a perovskite structure material.

In some embodiments, the atomic layer 41 may include graphene. The graphene may have a structure in which carbon atoms are two-dimensionally combined. The graphene has electronic structural characteristics exhibiting a linear energy distribution in the vicinity of the Fermi level. The atomic layer 41 including the graphene may thus exhibit a very high charge mobility in a plane direction thereof and a very low electrical resistance. As a result, the electron transmissive sheet 40 may allow the gate electrode 30 to prevent accumulation of electrons emitted from the emitter 15. The atomic layer 41 may also be referred to hereinafter as a graphene layer.

Hereinafter, examples are given to explain a transfer process of the electron transmissive sheet 40 and a formation of the fine openings 45. A multi- or single-layered graphene may be grown on a thin-layer of nickel (Ni) or copper (Cu). The graphene may be coated with PMMA (polymethyl metacrylate) and then be separated from the nickel or copper thin layer. The separated graphene may be transferred onto the gate electrode 30. A vacuum annealing may be employed to remove the PMMA from the transferred graphene. In some embodiments, a multi-layered graphene may be used in the transfer process. Through the steps above, the gate electrode 30 may be provided thereon with the electron transmissive sheet 40 in which a plurality of the graphene layers 41 are stacked. In other embodiments, a single-layered graphene may be used in the transfer process. For example, a plurality of the graphene layers 41 may be stacked on the gate electrode 30 by repeatedly performing a transfer process in which a single-layered graphene is transferred onto the gate electrode 30. The gate electrode 30 may thus be provided thereon with the electron transmissive sheet 40 in which a plurality of the graphene layers 41 are stacked.

When the transfer process is performed, some portions of the electron transmissive sheet 40 may include one to three graphene layers 41. Remaining portions of the electron transmissive sheet 40 may include four or more graphene layers 41. For example, the remaining portions of the electron transmissive sheet 40 may include eleven graphene layers 41. Accordingly, the some portions of the electron transmissive sheet 40 may be thinner than the remaining portions of the electron transmissive sheet 40.

The some portions of the electron transmissive sheet 40 may be easily torn or ruptured by the stress discussed above, in comparison with the remaining portions of the transmissive sheet 40. For example, the fine openings 45 may be formed on the some portions of the electron transmissive sheet 40. As discussed above, the fine openings 45 may relieve the thermal and/or mechanical stress between the gate electrode 30 and the electron transmissive sheet 40. The relief of the stress may allow the remaining portions of the electron transmissive sheet 40 to resist without being torn or ruptured. As a result, the field emission apparatus 1 may be manufactured at a high yield.

In addition, when the transfer process is performed, the some portions of the electron transmissive sheet 40 may be wholly or partially adjusted in width. The fine openings 45 may then be adjusted in width. When the some portions of the electron transmissive sheet 40 are wholly or partially adjusted in width, at least one of the fine openings 45 may have a different width W2 from those of other fine openings 45.

Figure 4:
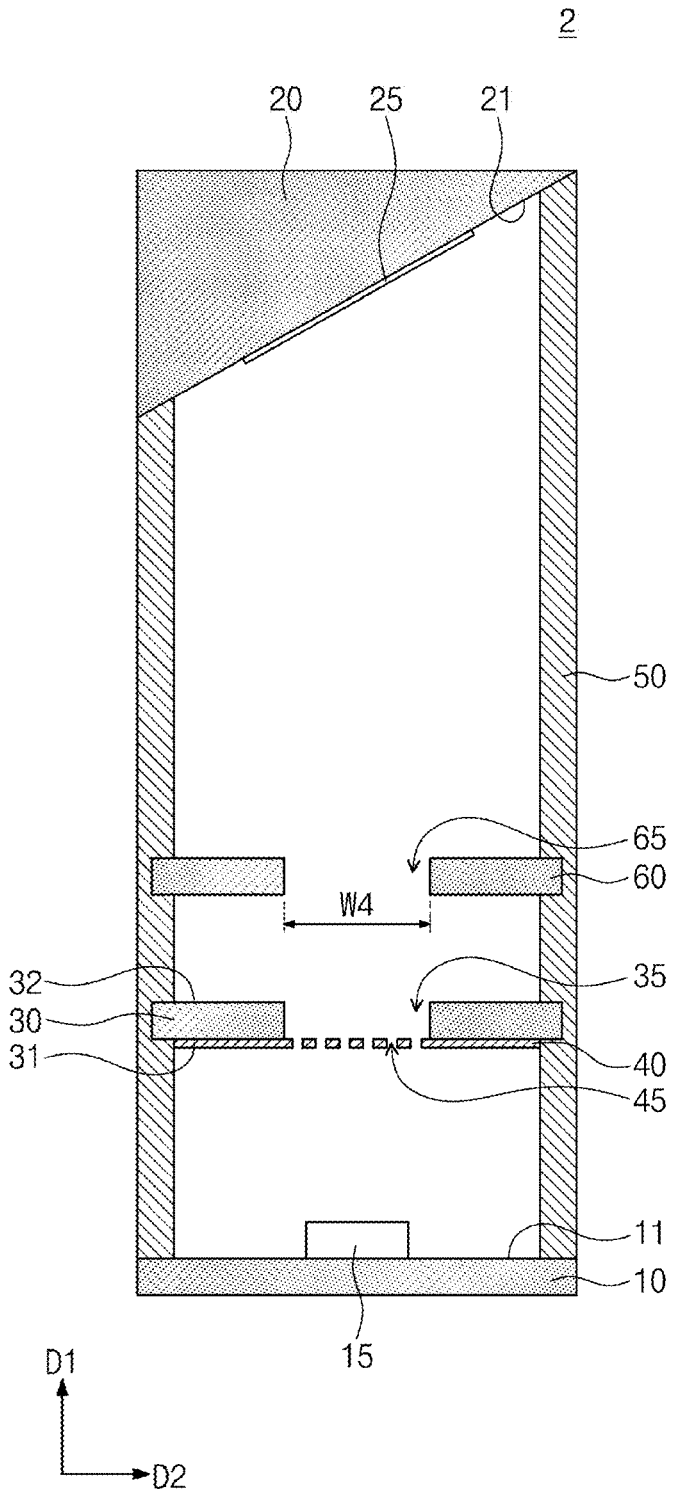
FIG. 4 illustrates a schematic diagram showing another example of the field emission apparatus of FIG. 1.

FIG. 4 illustrates a schematic diagram showing another example of the field emission apparatus in FIG. 1. In the embodiment that follows, components substantially the same as those of the embodiments discussed with reference to FIGS. 1 to 3 are omitted or abbreviated for brevity of the description.

Referring to FIG. 4, a field emission apparatus 2 according to embodiments of the present inventive concept may include the cathode electrode 10, the anode electrode 20, the gate electrode 30, the emitter 15, and the electron transmissive sheet 40. The field emission apparatus 2 may further include a focusing electrode 60 and the insulation member 50.

The focusing electrode 60 may focus electrons by applying a potential relative to those of other electrodes. For example, the focusing electrode 60 may create a field to distort a traveling path of an electron beam emitted from the emitter 15. The electron beam may then be focused. The focusing electrode 60 may be positioned between the cathode electrode 10 and the anode electrode 20. In some embodiments, a single focusing electrode 60 may be provided. In other embodiments, a plurality of focusing electrodes 60 may be provided.

The focusing electrode 60 may be shaped like a circular plate or disc. The focusing electrode 60 may be connected to an external power source (not shown). The focusing electrode 60 may be electrically insulated through the insulation member 50 from the cathode electrode 10, the anode electrode 20, and the gate electrode 30. In some embodiments, the focusing electrode 60 may be surrounded by the insulation member 50. The focusing electrode 60 may include a conductive material.

The focusing electrode 60 may include at least one focusing electrode aperture 65 penetrating therethrough. The focusing electrode aperture 65 may be positioned on the traveling path of the electron beam. The electron beam may thus pass through the focusing electrode aperture 65 to reach the anode electrode 20. The focusing electrode aperture 65 may vertically overlap the gate aperture 35. In some embodiments, the focusing electrode aperture 65 may have a width W4 roughly the same as the width (see W1 of FIG. 3) of the gate aperture 35. In other embodiments, the width W4 of the focusing electrode aperture 65 may be greater or less than the width W1 of the gate aperture 35.

The anode electrode 20 may have the bottom surface 21 facing the top surface 11 of the cathode electrode 10. The bottom surface 21 of the anode electrode 20 may be inclined to the traveling path of the electron beam. The bottom surface 21 of the anode electrode 20 may be inclined at a predetermined angle. The anode electrode 20 may include the target 25 on the bottom surface 21 thereof. In some embodiments, the target 25 may include a substance that emits an X-ray on collision with the electron beam.

Figure 5:
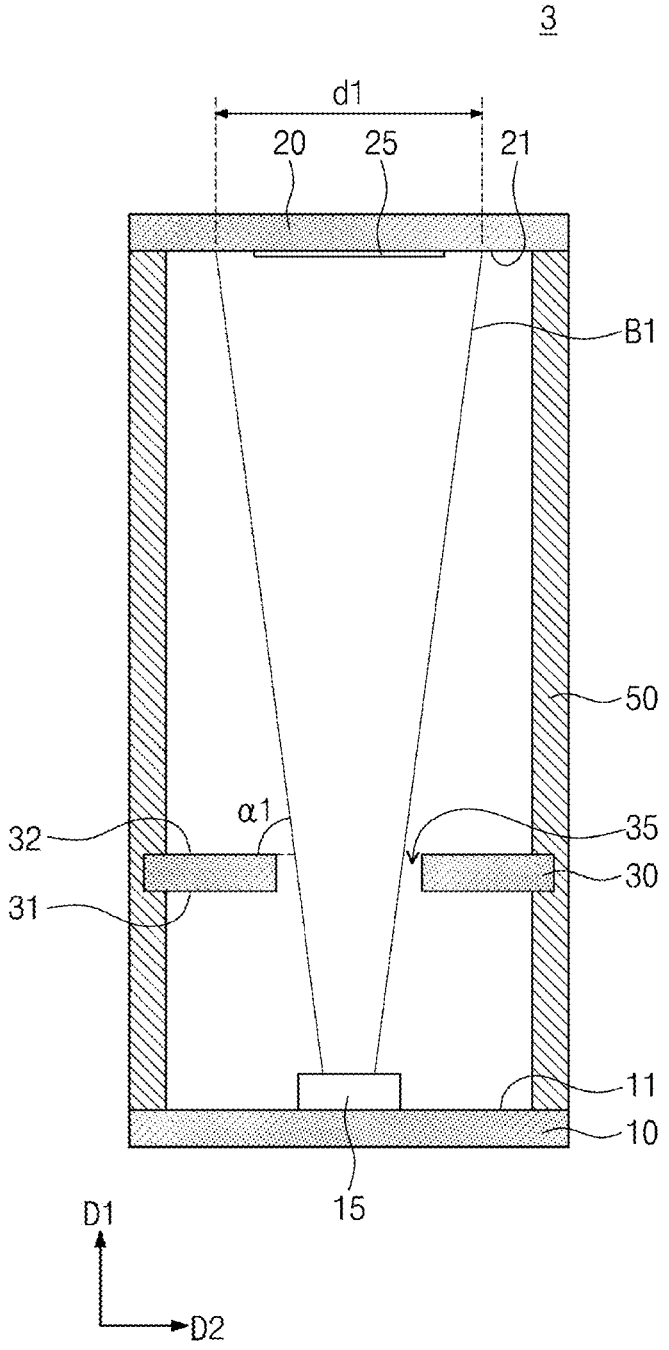
FIG. 5 illustrates a schematic diagram showing a trajectory of an electron beam emitted from a field emission apparatus without an electron transmissive sheet.
Figure 6:
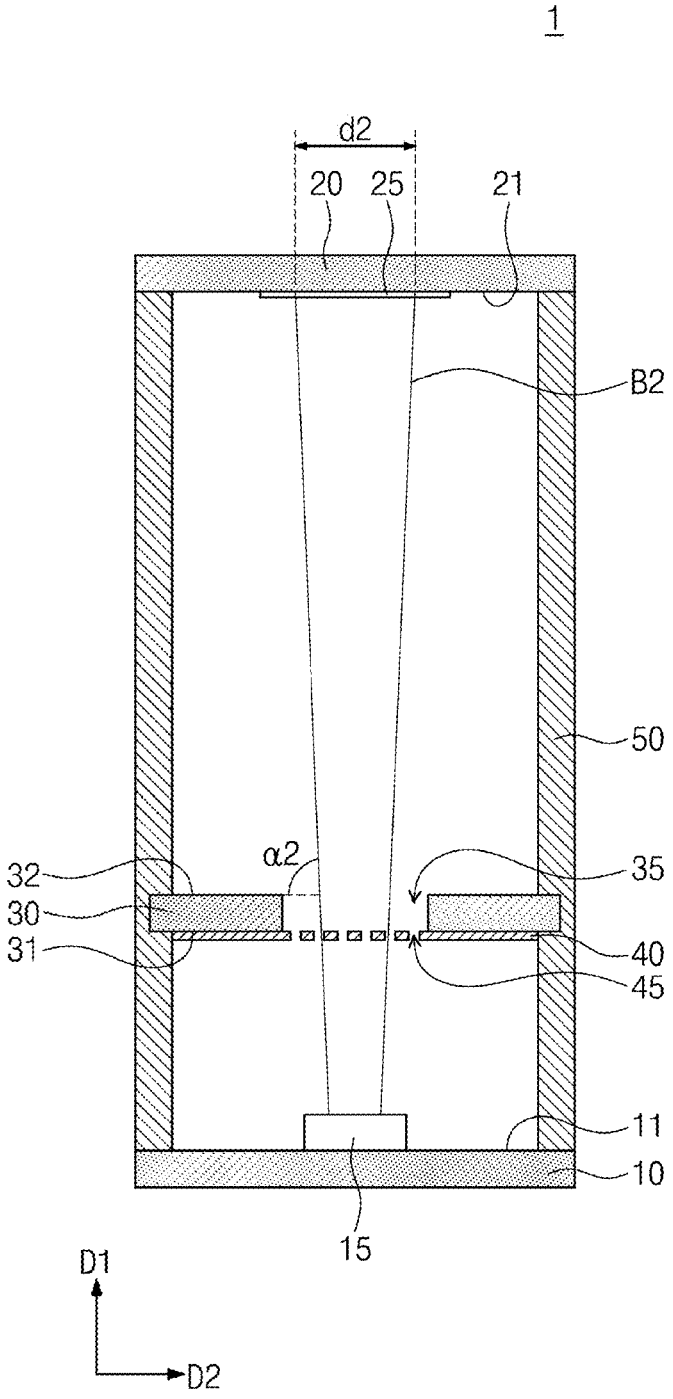
FIG. 6 illustrates a schematic diagram showing a trajectory of an electron beam emitted from the field emission apparatus of FIG. 1.
Figure 7:
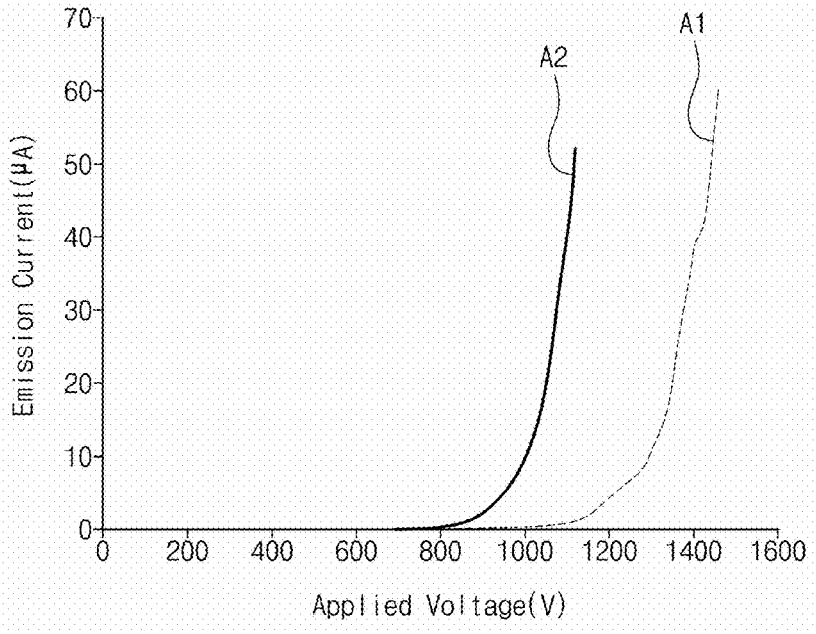
FIG. 7 illustrates a graph showing an emitted current from a field emission apparatus depending on whether or not an electron transmissive sheet is present.
Figure 8:
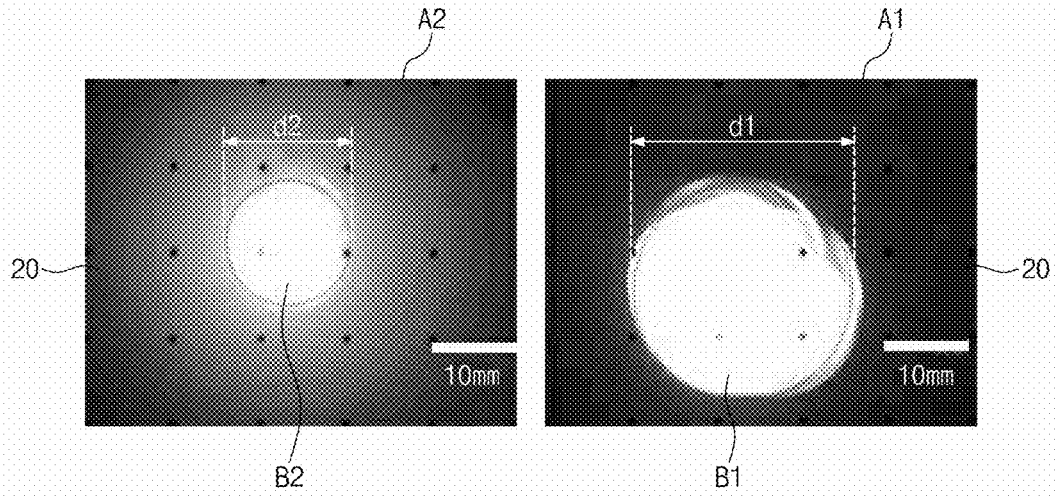
FIG. 8 illustrates a plan view showing electron beams of FIGS. 5 and 6 impinging on an anode electrode.

FIG. 5 illustrates a schematic diagram showing a trajectory of an electron beam emitted from a field emission apparatus without an electron transmissive sheet. FIG. 6 illustrates a schematic diagram showing a trajectory of an electron beam emitted from the field emission apparatus of FIG. 1. FIG. 7 illustrates a graph showing current emitted from a field emission apparatus depending on whether or not an electron transmissive sheet is present. FIG. 8 illustrates a plan view showing electron beams of FIGS. 5 and 6 impinging on an anode electrode. In FIGS. 7 and 8, a symbol A1 relates to the field emission apparatus 1 of FIG. 6, and a symbol A2 relates to a field emission apparatus 3 of FIG. 5.

Likewise the field emission apparatus 1 of FIG. 6, the field emission apparatus 3 of FIG. 5 may be constructed such that the gate electrode 30 and the cathode electrode 10 are spaced apart at a spacing (see L1 of FIG. 1) of about 200 μm and the gate aperture 35 has a width (see W1 of FIG. 3) of about 350 μm. The field emission apparatus 3 of FIG. 5 may have the emitter 15 whose width (see W3 of FIG. 1) is less than the width W1 (or a diameter) of the gate aperture 35. The field emission apparatus 1 of FIG. 6 may be constructed such that each of the fine openings 45 has the width (see W2 of FIG. 3) of about 5 μm and the fine openings 45 are spaced apart at the spacing (see L2 of FIG. 3) of about 50 μm.

Referring to FIG. 5, when the field emission apparatus 3 has no electronic emission sheet 40, the emitter 15 may emit an electron beam B1 that receives a force in a horizontal direction caused by a distorted spatial potential distribution around the gate aperture 35. The horizontal direction may be parallel to the second direction D2. This may cause the electron beam B1 to spread out horizontally. In addition, the electron beam B1 may make a first angle α1 with the second surface 32 of the gate electrode 30. When the electron beam B1 reaches the anode electrode 20, the electron beam B1 may form on the anode electrode 20 an electron beam region having a first diameter d1.

Referring to FIG. 6, the field emission apparatus 1 may include the electron transmissive sheet 40 having the fine openings 45. The electron transmissive sheet 40 may alleviate distortion of spatial potential distribution around the gate electrode 30. Accordingly, in comparison with the electron beam B1 emitted from the field emission apparatus 3, the field emission apparatus 1 may emit an electron beam B2 that receives a reduced force in the horizontal direction. Hence, the electron beam B2 of the field emission apparatus 1 in FIG. 6 may be more focused than the electron beam B1 of the field emission apparatus 3 in FIG. 5. The electron beam B2 may be inclined with the second surface 32 of the gate electrode 30 at a second angle α2 greater than the first angle α1. For example, the second angle α2 may be about 87.6°, and the first angle α1 may be about 82.9°. The electron beam B2 of FIG. 6 may form on the anode electrode 20 an electron beam region having a second diameter d2 less than the first diameter d1.

Figure 9:
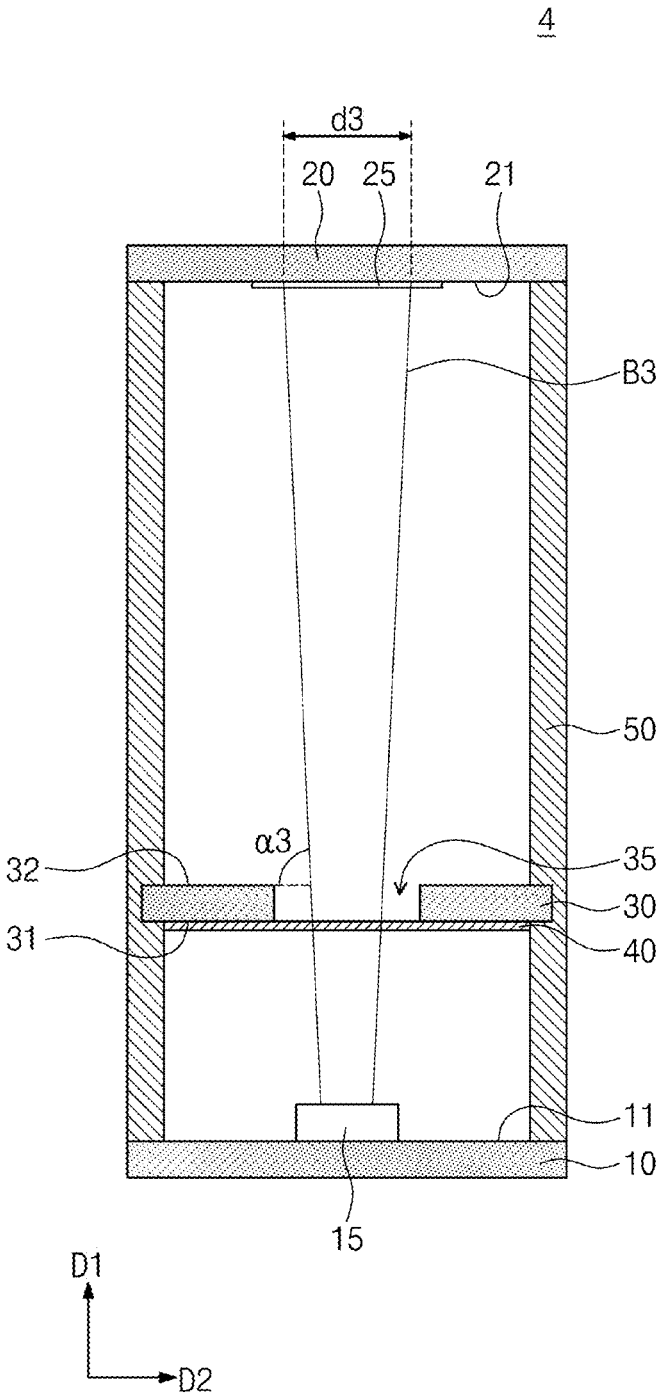
FIG. 9 illustrates a schematic diagram showing a trajectory of an electron beam emitted from a field emission apparatus whose electron transmissive sheet has no fine openings.
Figure 10:
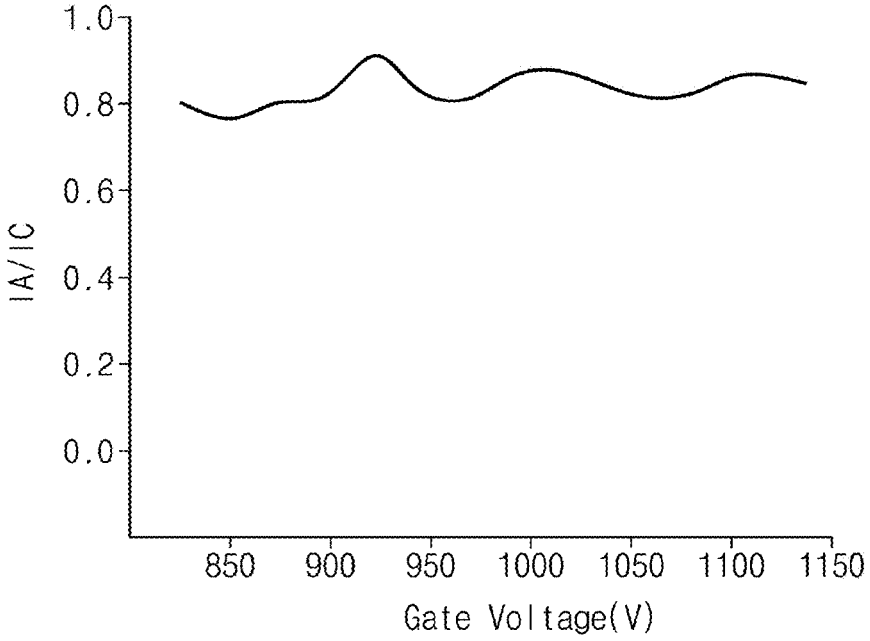
FIG. 10 illustrates a graph showing field emission characteristics of the field emission apparatus of FIG. 1.

FIG. 9 illustrates a schematic diagram showing a trajectory of an electron beam emitted from a field emission apparatus whose electron transmissive sheet has no fine apertures. FIG. 10 illustrates a graph showing field emission characteristics of the field emission apparatus of FIG. 1. A field emission apparatus 4 of FIG. 9 may have the same structure as that of the field emission apparatus 1 of FIG. 6, except for the fine openings 45. In FIG. 10, an X-axis may indicate a gate voltage applied to the gate electrode 30 of FIG. 6, a Y-axis may denote a ratio obtained by dividing a value of current flowing through the anode electrode 20 of FIG. 6 by a value of current flowing through the cathode electrode 10 of FIG. 6, and a solid line may represent how the ratio depends on the gate voltage.

Referring to FIGS. 6, 9, and 10, the electron beam B2 of the field emission apparatus 1 in FIG. 6 may have a focusing capability roughly the same as or similar to that of an electron beam B3 of the field emission apparatus 4 in FIG. 9. For example, the electron beam B3 may be inclined with the second surface 32 of the gate electrode 30 at a third angle α3 roughly the same as the second angle α2. As illustrated in FIG. 9, the electron beam B3 may form on the anode electrode 20 an electron beam region having a third diameter d3 roughly the same as the second diameter d2. When the fine openings 45 of FIG. 6 are formed to have a diameter (or a width) less than a spacing (see L2 of FIG. 3) thereof, the fine openings 45 may have an insignificant effect on the distortion of spatial potential distribution around the gate electrode 30. The focusing capability of the electron beam may thus be rarely affected by whether or not the fine openings 45 are present.

As discussed above, the thermal and/or mechanical stress may be generated between the electron transmissive sheet 40 and the gate electrode 30. The electron transmissive sheet 40 of FIG. 9 may be torn or ruptured by the stress. In contrast, the fine openings 45 may prevent the electron transmissive sheet 40 of FIG. 6 from being torn or ruptured. In this sense, the field emission apparatus 1 of FIG. 6 may be manufactured at a higher yield than that of the field emission apparatus 4 of FIG. 9.

In FIG. 10, a phrase IC may mean a current flowing through the cathode electrode 10, a phrase IA may express a current flowing through the anode electrode 20, and a phrase Gate Voltage may signify a voltage applied to the gate electrode 30.

A leakage current to the gate electrode 30 may reduce with increasing value, referred to hereinafter as a calculated value, obtained by dividing a value of current flowing through the anode electrode 20 by a value of current flowing through the cathode electrode 10. Therefore, the smaller calculated value may encourage the electron transmissive sheet 40 to have increased electron permeability. For example, the electron transmissive sheet 40 of FIGS. 6 and 9 may have a structure in which three graphene layers 41 are stacked. When an electron energy is about 1 keV, the electron transmissive sheet 40 of FIG. 6 with the fine openings 45 may have electron permeability of more than about 80%. The electron transmissive sheet 40 of FIG. 9 without the fine openings 45 may have electron permeability less than that of the electron transmissive sheet 40 of FIG. 6 with the fine openings 45. In conclusion, the fine openings 45 may enhance electron permeability of the electron transmissive sheet 40. The unit "eV" is an abbreviation for electron volt, which means magnitude of electron energy.

Figure 11:
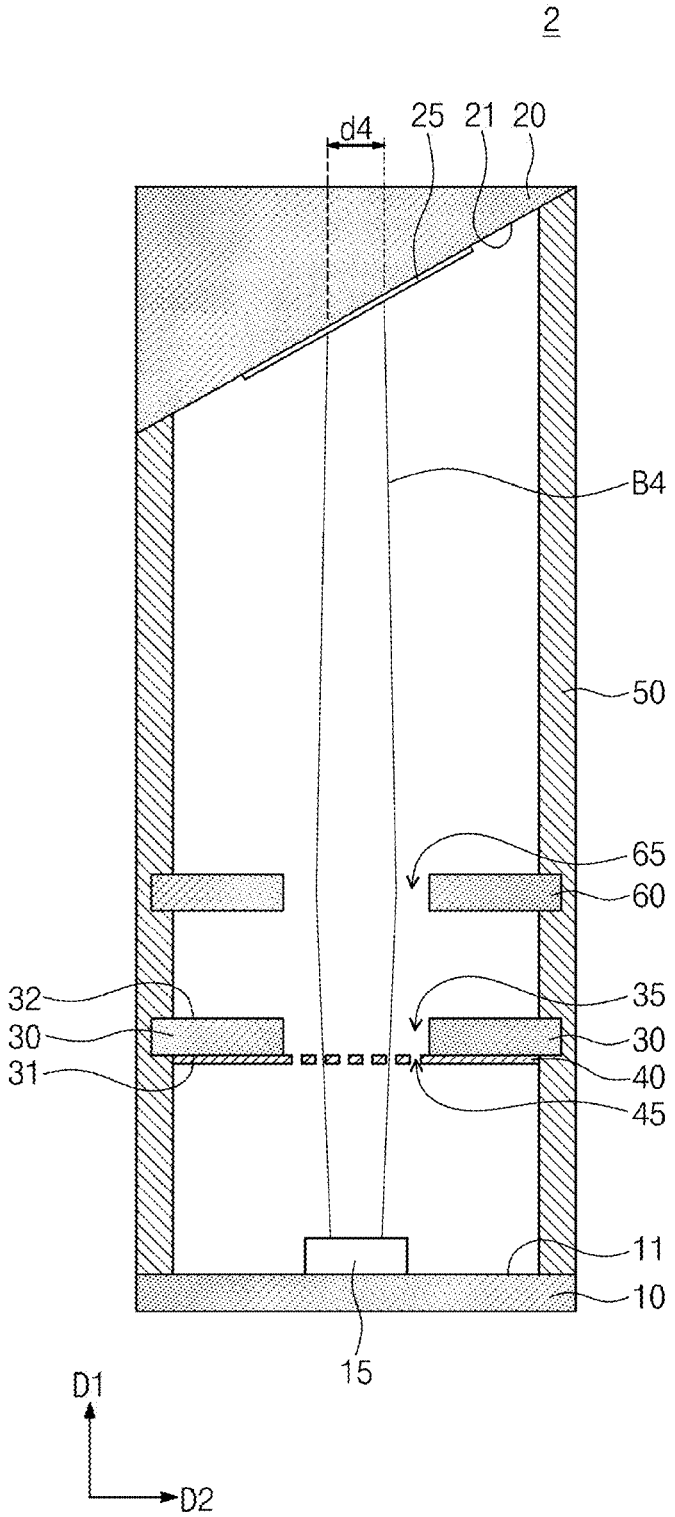
FIG. 11 illustrates a schematic diagram showing a trajectory of an electron beam emitted from the field emission apparatus of FIG. 4.

FIG. 11 illustrates a schematic diagram showing a trajectory of an electron beam emitted from the field emission apparatus of FIG. 4. The field emission apparatus 2 of FIG. 11 may have the same structure as that of the field emission apparatus 1 of FIG. 6, except for shapes of the focusing electrode 60 and the anode electrode 20.

Referring to FIGS. 6 and 11, the field emission apparatus 2 may emit an electron beam B4 whose traveling path is distorted by the focusing electrode 60, as discussed above, and the electron beam B4 may then be focused. Accordingly, in comparison with the electron beam B2 of FIG. 6, the electron beam B4 of FIG. 11 may be more tightly focused by the focusing electrode 60. For example, the electron beam B4 of FIG. 11 may form on the anode electrode 20 an electron beam region having a fourth diameter d4 less than the second diameter d2.

According to embodiments of the present inventive concept, the electron transmissive sheet may include a plurality of the fine openings. The thermal and/or mechanical stress may be alleviated between the gate electrode and the electron transmissive sheet in manufacturing a field emission apparatus, thereby enhancing production yield of the field emission apparatus. Furthermore, the electron transmissive sheet including the fine openings may reduce distortion of potential distribution. Therefore, the field emission apparatus may be enhanced in electron transmission performance and focusing capability of the electron beam.

Effects of the present inventive concept is not limited to the above-mentioned one, other effects which have not been mentioned above will be clearly understood to those skilled in the art from the following description.

Although the present invention has been described in connection with the embodiments of the present inventive concept illustrated in the accompanying drawings, it will be understood by one of ordinary skill in the art that variations in form and detail may be made therein without departing from the spirit and essential features of the inventive concept. The above disclosed embodiments should thus be considered illustrative and not restrictive.

What is claimed is:

1. A field emission apparatus, comprising:

a cathode electrode and an anode electrode spaced apart from each other;

an emitter on the cathode electrode;

a gate electrode between the cathode and anode electrodes and including at least one gate aperture overlapping the emitter; and an electron transmissive sheet on the gate electrode and including a plurality of fine openings overlapping the gate aperture, wherein each of the fine openings has a width in a range from 5 μm to 45 μm, wherein the gate electrode comprises a first surface facing the cathode electrode and a second surface facing the anode electrode, and wherein the electron transmissive sheet is positioned directly on the first surface.

2. The field emission apparatus of claim 1, wherein the electron transmissive sheet comprises at least one electron transmissive atomic layer, the electron transmissive atomic layer including a two-dimensional material.

3. The field emission apparatus of claim 2, wherein the two-dimensional material comprises at least one of graphene, molybdenum disulfide ($MoSO_2$), tungsten disulfide ($WS_2$), hexagonal boron nitride (h-BN), molybdenum ditelluride ($MoTe_2$), and transition metal dichalcogenide (TMDC).

4. The field emission apparatus of claim 1, wherein the width of each of the fine openings is less than a spacing between adjacent ones of the fine openings.

5. The field emission apparatus of claim 4, wherein the width of each of the fine openings is less than one-third a width of the gate aperture.

6. The field emission apparatus of claim 5, wherein the width of each of the fine openings is less than one-third a spacing between the cathode electrode and the gate electrode.

7. The field emission apparatus of claim 1, wherein the gate aperture has a width greater than that of the emitter.

8. The field emission apparatus of claim 1, further comprising at least one focusing electrode between the anode electrode and the gate electrode, wherein the focusing electrode comprises a focusing electrode aperture vertically overlapping the gate aperture.

9. The field emission apparatus of claim 1, wherein the emitter is positioned on a surface of the cathode electrode, the surface of the cathode electrode facing the anode electrode.

10. The field emission apparatus of claim 1, wherein the anode electrode comprises a target on its surface facing the cathode electrode.

11. The field emission apparatus of claim 1, wherein the cathode electrode and the gate electrode are spaced apart at a spacing of more than about 150 μm and less than about 500 μm.

12. The field emission apparatus of claim 1, wherein at least one of the fine openings has a different width from those of other fine openings.

13. The field emission apparatus of claim 1, wherein the fine opening has a width within a range in which a trajectory of an electron beam emitted from the emitter is not substantially distorted by distortion of potential distribution caused by the fine opening.

14. The field emission apparatus of claim 1, wherein a spacing between the cathode electrode and the gate electrode is greater than 150 μm.

15. The field emission apparatus of claim 1, wherein the plurality of fine openings are arranged in a regular pattern.

16. The field emission apparatus of claim 1, wherein the plurality of fine openings are arranged in an irregular pattern, the plurality of fine openings being arranged asymmetrically with respect to the emitter when seen in a plan view.

* * * * *